US006675693B1

(12) United States Patent
Heayn

(10) Patent No.: US 6,675,693 B1
(45) Date of Patent: Jan. 13, 2004

(54) COMBAT AMMUNITION PACK

(75) Inventor: Michael Heayn, Flanders, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/249,031

(22) Filed: Mar. 11, 2003

(51) Int. Cl.[7] ..... F42B 39/02
(52) U.S. Cl. ..... 89/34
(58) Field of Search ..... 89/33.01, 34; 42/50

(56) References Cited

U.S. PATENT DOCUMENTS 5,138,787 A * 8/1992 Riddle et al. ..... 42/98
6,439,098 B1 * 8/2002 Dillon ..... 89/34

OTHER PUBLICATIONS

Commerce Business Daily Issue, "Combat Ammunition Pack for 7.62 M240 Machine Gun," Sep. 24, 1999.*

* cited by examiner

*Primary Examiner*—Michael J. Carone
*Assistant Examiner*—Troy L. Chambers
(74) *Attorney, Agent, or Firm*—John F. Moran; Michael Sachs

(57) ABSTRACT

An apparatus (i.e., a combat ammunition pack) for holding ammunition for a machine gun includes a bracket assembly that removably attaches to the machine gun; a belt guide attached to the bracket assembly for guiding a belt of ammunition into the machine gun; a front collar assembly removably attached to the bracket assembly; and a bag assembly attached to the bracket assembly and the front collar assembly wherein the bag assembly can be opened and closed while the machine gun is firing.

12 Claims, 6 Drawing Sheets

Fig. 2A
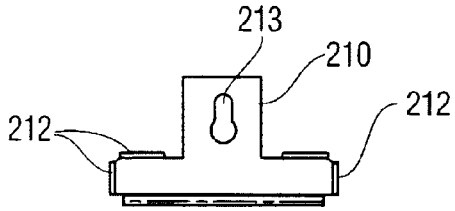
Fig. 2C
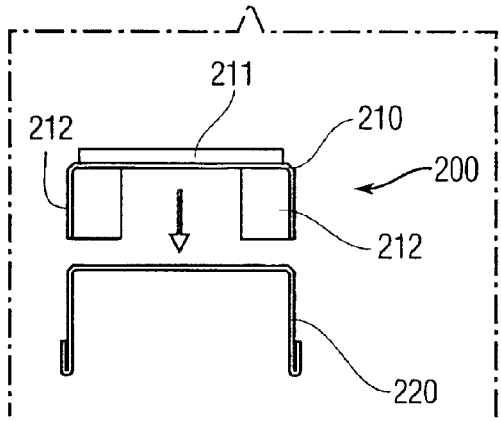
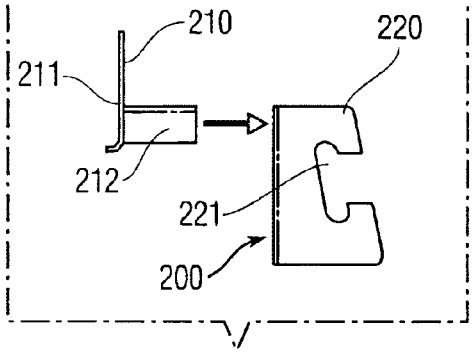
Fig. 2B
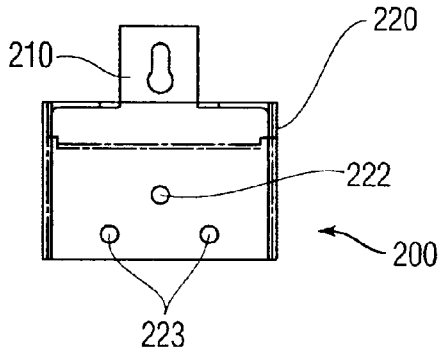
Fig. 2D

Fig. 4D
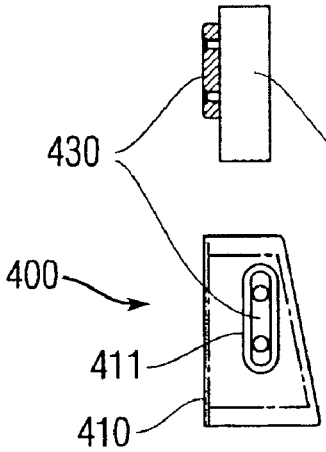
Fig. 4C
Fig. 4B
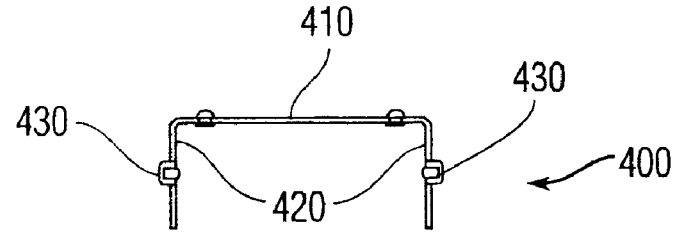
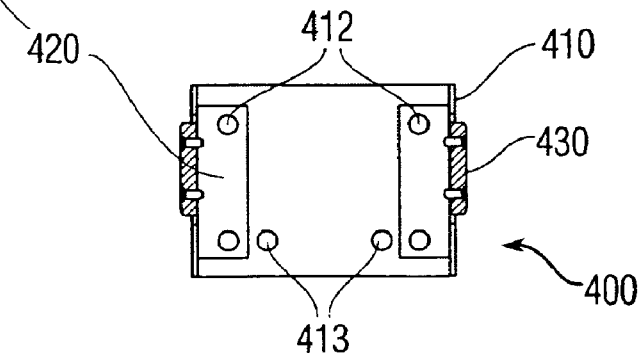
Fig. 4A

COMBAT AMMUNITION PACK

BACKGROUND OF INVENTION

The invention relates in general to small caliber ammunition containers and magazines, and in particular to belted ammunition containers attachable to machineguns.

Machineguns, such as the M240 machinegun, are belt fed weapons. When employed in dismounted operations, the machinegun is often transported with a "starter belt" of ammunition, usually about 30 rounds, loaded into the weapon. The starter belt is used at the beginning of an engagement, with a longer belt of ammunition attached to its loose end, or loaded into the weapon for continued operation. The starter belt is normally hung over the feed tray cover of the weapon, or draped over the left forearm of the machine gunner. Starter belts transported in the preceding manner are subject to becoming caught in foliage and are unprotected from adverse environmental conditions.

Ammunition containers presently employed with machineguns such as the M240 machinegun do not provide convenient access to the loose end of the belt for attachment of additional ammunition. Further, if the weapon's feed tray cover is opened, the weight of the hanging belt of ammunition may pull the belt out of the feed mechanism. Prior ammunition packs are able to contain ammunition, however, the prior packs cannot be opened to allow additional ammunition to be connected to the starter belt in the pack.

The present invention, a combat ammunition pack (CAP), provides a means for securely attaching, containing and protecting an ammunition starter belt, comprising up to 100 rounds of belted ammunition. The CAP is attached to a machinegun such as the M240 machinegun. The CAP also provides a means for connecting another belt of ammunition to the loose end of the starter belt while the weapon is being fired. Further, the CAP provides a means for preventing the weight of the ammunition belt from pulling the belt out of the weapon's feed mechanism when the feed tray cover is opened.

SUMMARY OF INVENTION

One feature of the present invention is a means for quickly and securely attaching an ammunition starter belt container to a machinegun such as the M240 machinegun. The CAP achieves this through the use of a bracket, which fits over a headed pin extending from the left side of the weapon and the bottom edge of the bracket resting on a flat surface on the weapon.

Another feature of the present invention is a means for containing and protecting a starting belt comprising up to 100 rounds of belted ammunition. This is accomplished using a fabric bag, which holds the ammunition belt and protects it from the outside environment.

Still another feature of the present invention is a means for conveniently attaching another belt of ammunition to the end of the starter belt while the weapon is being fired. The CAP accomplishes this by allowing the fabric bag to be opened from the top along both sides for access to the free end of the ammunition belt while ammunition is being fed into the weapon.

One more feature of the present invention is a means for preventing the ammunition belt from pulling out of the weapon's feed mechanism when the feed tray cover is opened. A belt guide within the CAP prevents the weight of the ammunition belt from pulling the belt out of the feed mechanism.

The invention will be better understood, and further objects, features, and advantages thereof will become more apparent from the following description of the preferred embodiments, taken in conjunction with the accompanying drawings.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

FIG. 2A is a front view of the bracket.

FIG. 2B is a side view of the bracket and back collar shown disconnected.

FIG. 2C is a top view of the bracket and back collar shown disconnected.

FIG. 2D is a rear view of the bracket assembly.

FIG. 4A is a front view of the front collar assembly.

FIG. 4B is a top view of the front collar assembly.

FIG. 4C is a side view of the front collar assembly.

FIG. 4D is a front view of the spring tabs and push buttons.

The sizes of the different components in the figures may not be in exact proportion, and are shown only for visual clarity and for the purpose of explanation.

DETAILED DESCRIPTION

A CAP 100 according to a first embodiment of the present invention is depicted in FIGS. 1 through 7.

Figure 1:
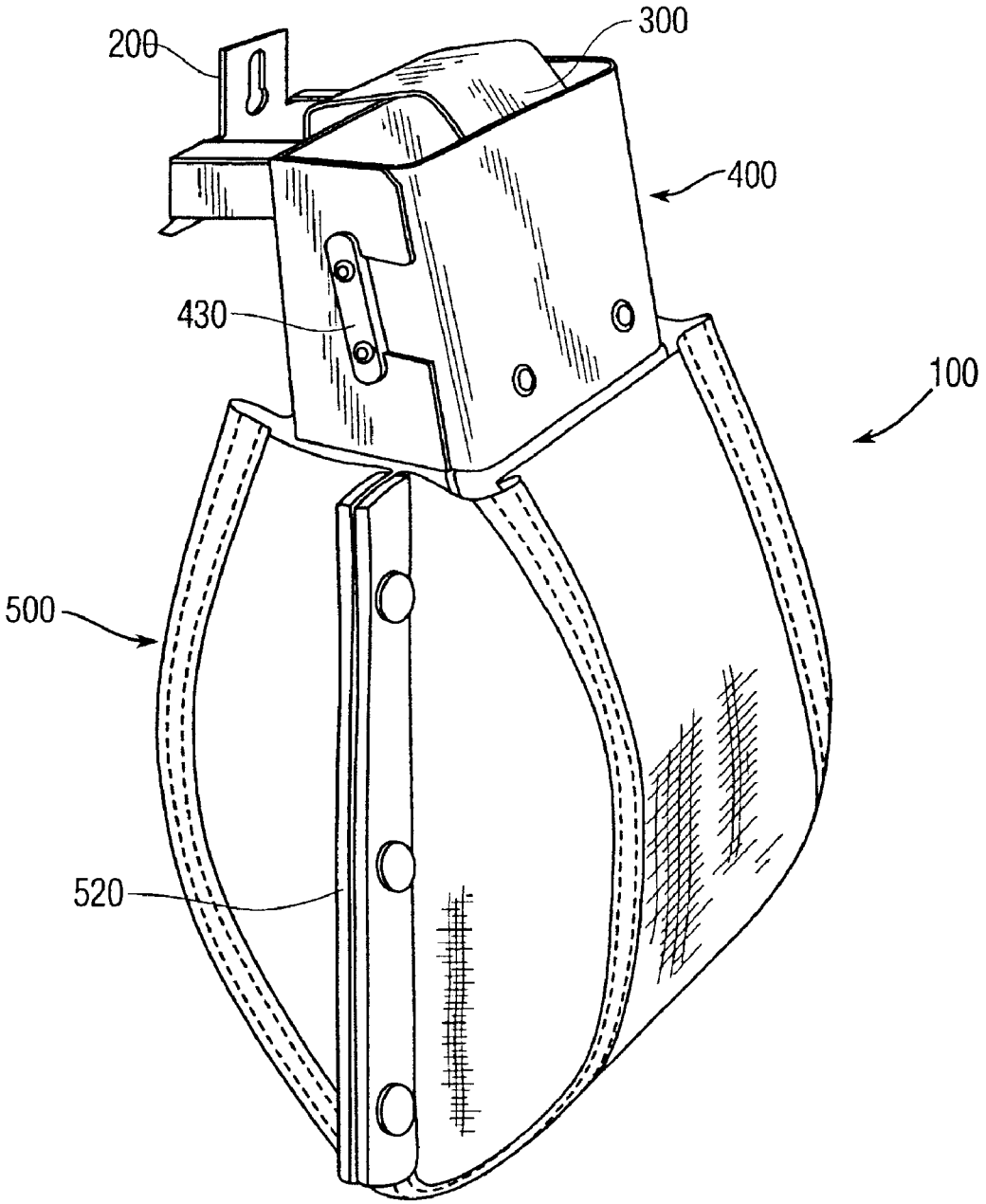
FIG. 1 is a left rear view of one embodiment of a CAP according to the invention.
Figure 3:
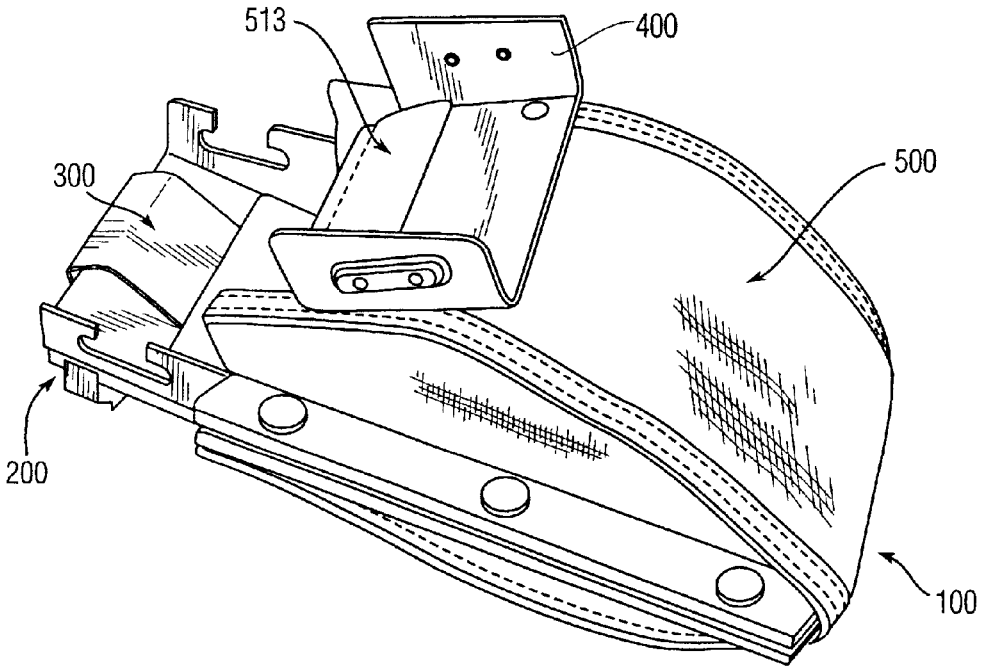
FIG. 3 left rear view of the CAP of FIG. 1 with the front collar disconnected from bracket assembly.

FIG. 1 is a left rear view of one embodiment of a CAP according to the invention. FIG. 1 shows the four main components that make up the CAP 100: bracket assembly 200, belt guide 300, front collar assembly 400, and bag assembly 500. Bracket assembly 200 provides interfaces for mounting the CAP on a machinegun, such as an M240, attachment means for front collar assembly 400, and assembly interfaces for one end of bag assembly 500, and belt guide 300.

FIG. 2A is a front view of the bracket. FIG. 2B is a side view of the bracket and back collar shown disconnected. FIG. 2C is a top view of the bracket and back collar shown disconnected.

FIG. 2D is a rear view of the bracket assembly. Referring to FIGS. 2A–D, bracket assembly 200 comprises a bracket 210 and a back collar 220. Bracket 210 and back collar 220 may be made of, for example, sheet metal welded together. Bracket 210 has a "J" shaped vertical face 211 with tabs 212 extending perpendicular from the sides opposite the face 211. A generally keyhole shaped slot 213, centered toward the top of the face 211, fits over a headed pin (not shown) on the machine gun feed tray to hold the CAP in place on the machinegun. Tabs 212 form a standoff from back collar 220 allowing space for bag assembly 500 to hang freely from the side of the machinegun. Back collar 220 is channel shaped with slots 221, partially open to the outside, on both sides, and holes 222 and 223 through the face. The slotted sides are attachment points for push buttons 430 on the front collar assembly 400.

Openings, facing outward from the slots 221, permit removal of front collar assembly 400 from bracket assembly 200 (FIG. 3) when the push buttons 430 are depressed. Hole 222, centered horizontally in the face, is for assembly of belt guide 300 to back collar 220. Holes 223 are attachment interfaces for bag assembly 500.

Figure 6:
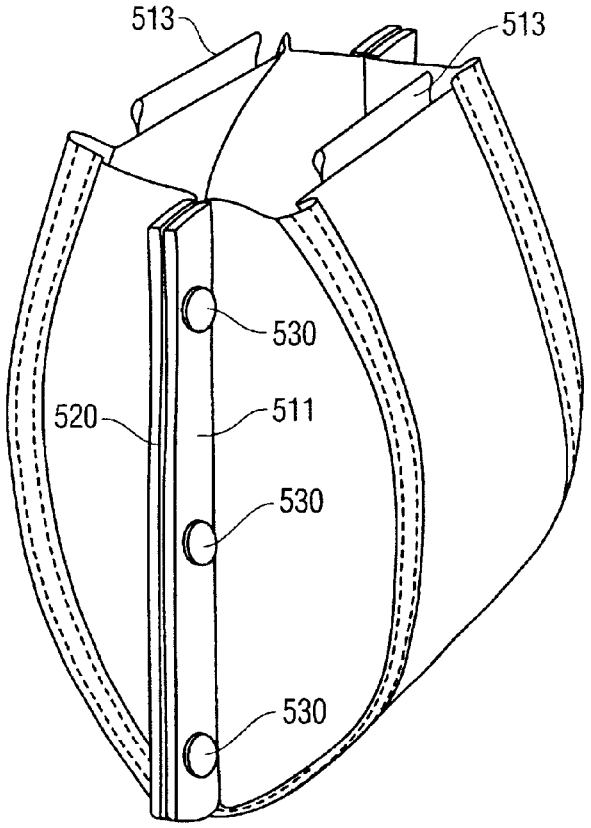
FIG. 6 is a side view of the belt guide.

FIG. 6 is a side view of the belt guide 300. Belt guide 300 (FIGS. 1, 3 and 6) is riveted to back collar 220. Belt guide 300 is made of, for example, spring steel. Belt guide 300 is configured to function as a guide for belted ammunition feeding out of the CAP 100. Also, with front collar 400 attached to bracket assembly 200, belt guide 300 prevents the weight of the ammunition belt from pulling the belt out of the machinegun's feed mechanism.

FIG. 4A is a front view of the front collar assembly. FIG. 4B is a top view of the front collar assembly. FIG. 4C is a side view of the front collar assembly. FIG. 4D is a front view of the spring tabs and push buttons. Front collar assembly 400 (FIGS. 1, 3 and 4A–D) is comprised of front collar 410, spring tabs 420 and push buttons 430. Channel shaped sheet metal front collar 410, with slots 411 in both sides, is sized to fit inside back collar 220. Holes 412 through the face at the top and bottom toward the sides are for attachment of spring tabs 420. Holes 413 through the face are attachment interfaces for bag assembly 500.

Spring tabs 420 are mirror images of each other and are made of, for example, "L" shaped spring steel. Spring tabs 420 include holes spaced for rivet attachment to the inside of front collar 410 and attachment of push buttons 430. Push buttons 430 are similar in shape to slots 411 in front collar 410 with their outside profile and thickness sized to fit easily within, and protrude through, slots in front collar 410 and back collar 220. Push buttons 430 are riveted to the outside of spring tabs 420. Pushing in on the buttons 430 allows front collar assembly 400 to be inserted into back collar 220. When released, spring tabs 420 force buttons 430 into slots 221 thereby holding bracket assembly 200 and front collar assembly 400 together (FIG. 1).

Figure 5:
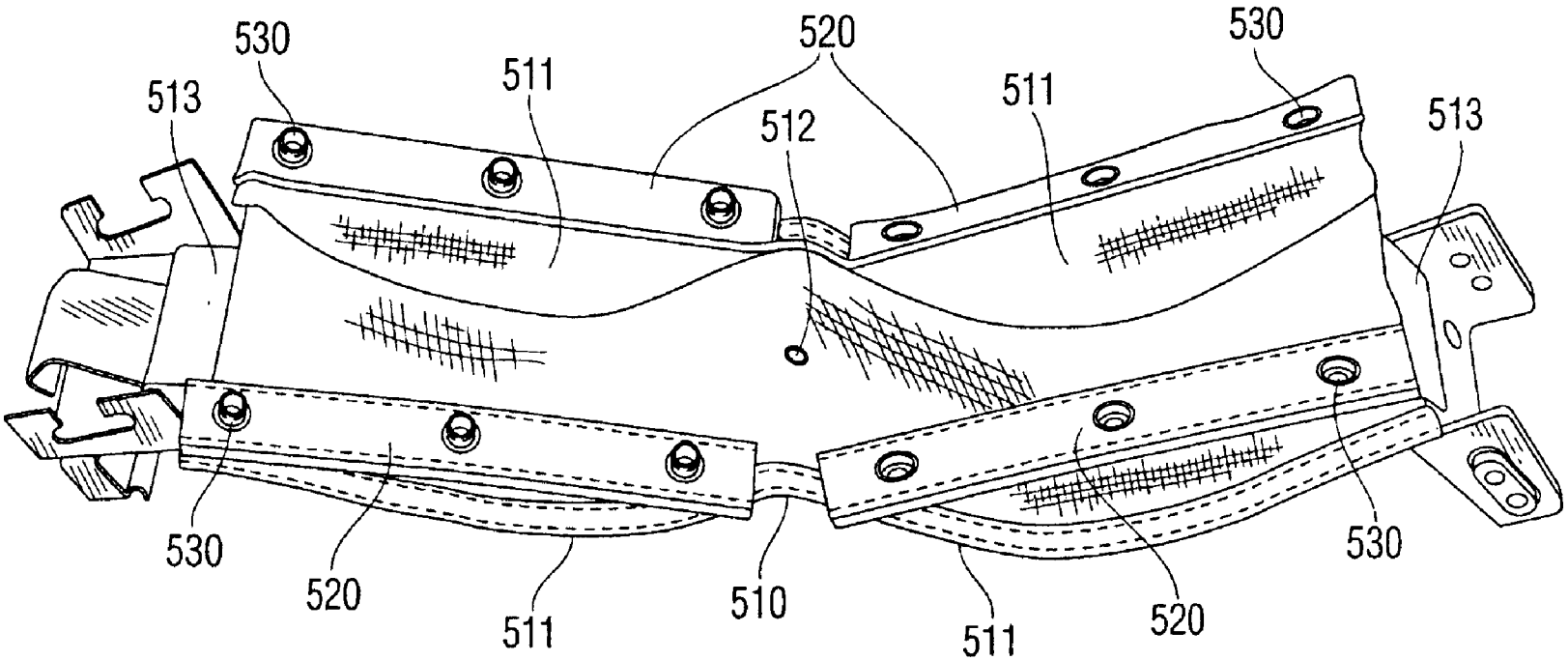
FIG. 5 is a left side view of the CAP with the bag assembly opened.
Figure 7:
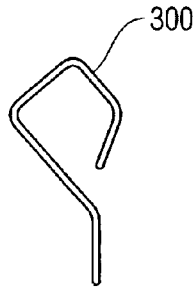
FIG. 7 is a perspective view of the bag assembly.
Figure 8:
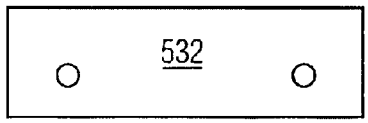
FIG. 8 is a front view of a rectangular plate.

Bag assembly 500 (FIGS. 1, 3, 5 and 7) is sized to hold a specified length of belted ammunition. Bag 510 is of sewn fabric construction with half sides 511 on both sides of the midsection along the length (FIGS. 5 and 7). Bag 510 is preferably made of a waterproof material, for example, nylon. Grommet backed up hole 512 allows water to drain from the closed bag assembly. Sewn loops 513 (FIGS. 3, 5 and 7) across the width at both ends are used to hold rectangular sheet metal plates 532 (FIG. 8) that back up riveted attachment of bag assembly 500 to front collar assembly 400 and bracket assembly 200. One or both of hook and loop fasteners 520 and button snaps 530 are attached to outward facing tabs on each half side 511 and securely hold the half sides 511 closed when folded together at the midsection along the length (FIGS. 1 and 7).

Operation of the CAP is as follows. 1) Load CAP with belt of ammunition. 2) Attach CAP to weapon. 3) Allow ammo to feed into weapon when firing. 4) (If need be) Open collar and pull bag open. 5) Attach additional ammo to end of belt in bag. 6) Continue to fire. 7) Close bag and move with weapon, or open feed tray cover of gun and remove bag.

The described embodiments are included for the purposes of illustration, and are not intended to be the exclusive; rather, they can be modified within the scope of the invention. Other modifications may be made when implementing the invention for a particular application.

What is claimed is:

1. An apparatus for holding ammunition for a machine gun, comprising:

a bracket assembly that removably attaches to the machine gun;

a belt guide attached to the bracket assembly for guiding a belt of ammunition into the machine gun;

a front collar assembly removably attached to the bracket assembly; and a bag assembly attached to the bracket assembly and the front collar assembly wherein the bag assembly can be opened and closed while the machine gun is firing.

2. The apparatus of claim 1 wherein the bracket assembly comprises a bracket and a back collar, the bracket being attached to the back collar.

3. The apparatus of claim 2 wherein the bracket comprises a generally j-shaped vertical face and a pair of tabs extending perpendicular to the vertical face to connect to the back collar, the vertical face including a generally keyhole shaped slot for insertion of a pin on the machinegun, the back collar having a channel shape with sides of the back collar including slots formed therein, a front of the back collar including a hole for attaching the belt guide and a pair of holes for attaching the bag assembly.

4. The apparatus of claim 3 wherein the front collar assembly comprises a front collar having a channel shape with sides of the front collar including slots formed therein, the front collar being of a size to fit inside the back collar.

5. The apparatus of claim 4 wherein the front collar assembly further comprises a pair of generally L-shaped spring tabs attached to an interior of the front collar and a pair of push buttons attached to the spring tabs, the push buttons having a shape and size to fit in the slots of the sides of the front collar and the slots in the sides of the back collar whereby depressing the push buttons allows the front collar to be inserted into the back collar and releasing the push buttons causes the spring tabs to force the push buttons into the slots in the sides of the back collar and the slots in the sides of the front collar thereby holding together the bracket assembly and the front collar assembly.

6. The apparatus of claim 5 wherein the bag assembly comprises a bag for holding belted ammunition, the bag comprising a midsection and a pair of half sides on either side of the midsection.

7. The apparatus of claim 6 wherein the bag further comprises loops at ends of the midsection, the bag assembly further comprising rectangular plates inserted into the loops for attaching the bag assembly to the bracket assembly and the front collar assembly.

8. The apparatus of claim 7 wherein the bag includes a hole at a bottom thereof for draining water.

9. The apparatus of claim 6 wherein the half sides include hook and loop fasteners for opening and closing the bag.

10. The apparatus of claim 6 wherein the half sides include button snaps for opening and closing the bag.

11. The apparatus of claim 6 wherein the half sides include hook and loop fasteners and button snaps for opening and closing the bag.

12. The apparatus of claim 6 wherein the bag comprises nylon.

* * * * *

UNITED STATES PATENT AND TRADEMARK OFFICE
Certificate

Patent No. 6,675,693 B1

Patented: January 13, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael Heayn, Wharton, NJ (US); Kenneth R. Jones, Wayne, NJ (US); and Richard Beckman, Randolph, NJ (US).

Signed and Sealed this Twentieth Day of March 2007.

MICHAEL J. CARONE
*Supervisory Patent Examiner*
Art Unit 3641